US009687118B2

(12) United States Patent
Schindler

(10) Patent No.: US 9,687,118 B2
(45) Date of Patent: Jun. 27, 2017

(54) CARRIER BODY FOR SANITARY SURFACE MATERIAL, METHOD OF ADAPTING SUCH A CARRIER BODY TO FLOOR DIMENSIONS OF A SANITARY SHOWER FACILITY, AND USE OF THE CARRIER BODY

(75) Inventor: Martin Schindler, Munich (DE)

(73) Assignee: SwissPal AG (CH)

( * ) Notice: Subject to any disclaimer, the term of this patent is extended or adjusted under 35 U.S.C. 154(b) by 837 days.

(21) Appl. No.: 12/682,625

(22) PCT Filed: Oct. 20, 2008

(86) PCT No.: PCT/EP2008/008872

§ 371 (c)(1),
(2), (4) Date: Apr. 20, 2010

(87) PCT Pub. No.: WO2009/053019

PCT Pub. Date: Apr. 30, 2009

(65) Prior Publication Data

US 2010/0218310 A1 Sep. 2, 2010

(30) Foreign Application Priority Data

Oct. 19, 2007 (DE) ..... 10 2007 050 150

(51) Int. Cl.
*A47K 3/00* (2006.01)
*A47K 3/40* (2006.01)
*A47K 3/16* (2006.01)

(52) U.S. Cl.
CPC ..... *A47K 3/40* (2013.01); *A47K 3/1605* (2013.01)

(58) Field of Classification Search
CPC ..... A47K 3/40; A47K 3/281; E03F 5/0407
(Continued)

(56) References Cited

U.S. PATENT DOCUMENTS 2,239,969 A * 4/1941 Morthland ..... 428/74
3,139,627 A * 7/1964 Rice ..... 52/35
(Continued)

FOREIGN PATENT DOCUMENTS

AT 6453 U1 11/2003
DE 202005002299 U1 5/2005
(Continued)

OTHER PUBLICATIONS

International Search Report issued in parent PCT/EP2008/008872, 6 pages.

*Primary Examiner* — Lauren Crane
(74) *Attorney, Agent, or Firm* — Hooker & Habib, P.C.

(57) ABSTRACT

The invention relates to a carrier body (1) for sanitary surface material, having a bearing surface for the sanitary surface material, having a floor surface for arranging on an underlying surface, having a through-opening which runs approximately in the vertical direction of the horizontal carrier body, and forms lateral end surfaces, and having a sealing element, which covers over at least one of the surfaces at least in part, wherein the sealing element on the at least one surface is fixed only to a first sub-region (11) and loosely covers over at least a further, second sub-region (12) of the surface. The invention also relates to a method of adapting such a carrier body to the desired floor dimensions of a sanitary shower facility, and to the use of this carrier body for a sanitary cubicle.

9 Claims, 5 Drawing Sheets

Figure 1:
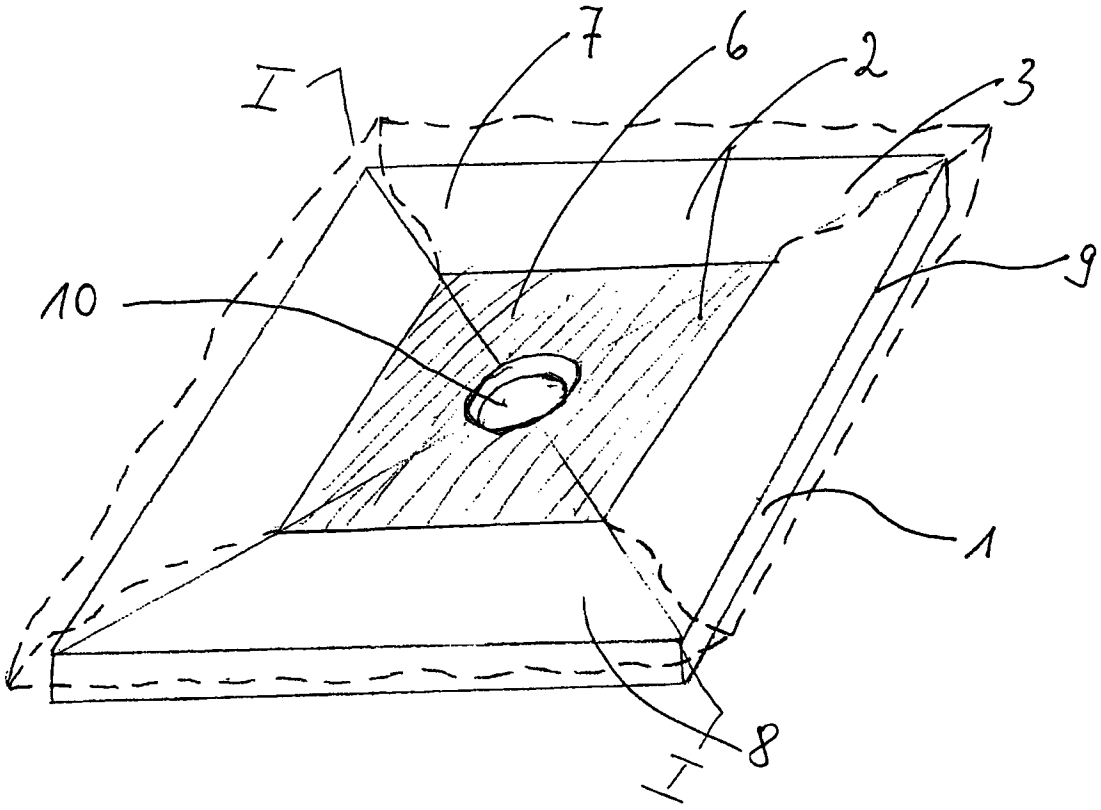

(58) Field of Classification Search
USPC ..... 4/612, 613
See application file for complete search history.

(56) References Cited

U.S. PATENT DOCUMENTS

| | | | | | |
|---|---|---|---|---|---|
| 3,606,617 | A * | 9/1971 | Frazier | 4/613 | |
| 3,675,384 | A * | 7/1972 | Knecht | 52/250 | |
| 4,557,004 | A * | 12/1985 | Piana | 4/613 | |
| 5,845,347 | A * | 12/1998 | Young | 4/613 | |
| 5,913,777 | A * | 6/1999 | Gerber | 52/35 | |
| 6,003,169 | A * | 12/1999 | Davis, Jr. | 4/613 | |
| 7,624,542 | B2 | 12/2009 | Hatrick-Smith | | |
| 8,132,275 | B2 | 3/2012 | Wilson et al. | | |
| 2003/0089059 | A1* | 5/2003 | Kirby | A47K 3/40 52/265 | |
| 2005/0028270 | A1* | 2/2005 | Nehring | 4/613 | |
| 2007/0130685 | A1* | 6/2007 | Huang et al. | 4/613 | |

FOREIGN PATENT DOCUMENTS

| | | | |
|---|---|---|---|
| DE | 202006012825 | U1 | 12/2006 |
| DE | 102006047437 | B3 | 7/2008 |

* cited by examiner

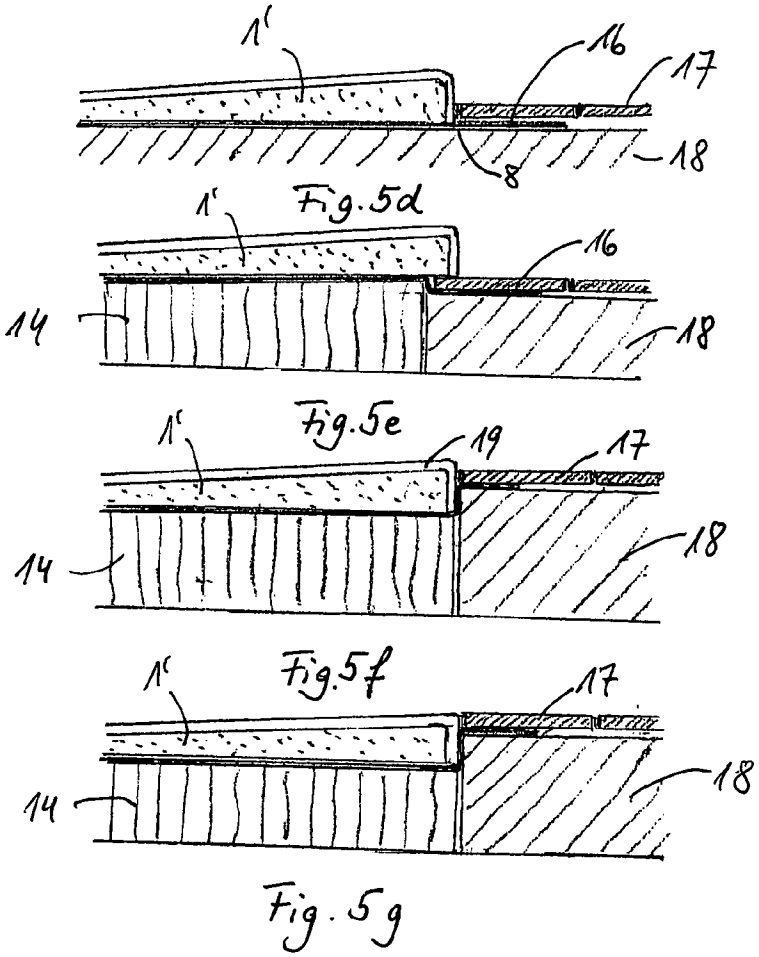
Fig.5d
Fig.5e
Fig.5f
Fig.5g
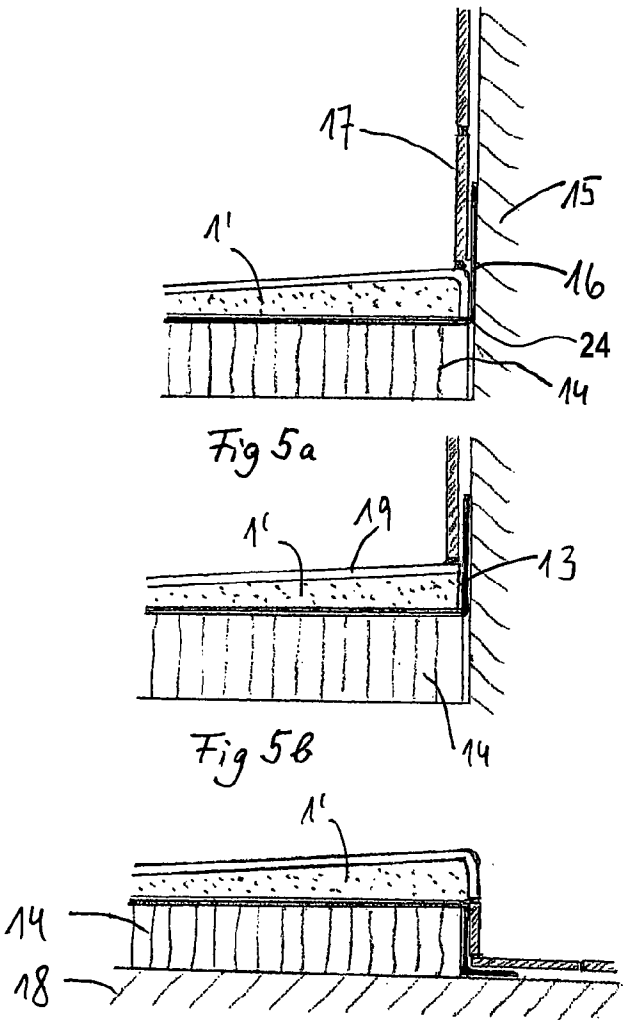
Fig 5a
Fig 5b
Fig 5c

CARRIER BODY FOR SANITARY SURFACE MATERIAL, METHOD OF ADAPTING SUCH A CARRIER BODY TO FLOOR DIMENSIONS OF A SANITARY SHOWER FACILITY, AND USE OF THE CARRIER BODY

The present invention concerns a carrier body. Further, the invention relates to a method for adapting such a carrier body to a desired underlaying flooring within a predetermined dimensioning for a sanitary shower facility. In addition, the invention discloses methods of installation and usage of said carrier body.

A carrier body is made known in EP 1 388 317 A1.

Where shower facilities are involved, types may be included which function within enclosed cabinets or possibly lack protective sidewall structures, thus forming simple shower installations. An ongoing problem for a selection of such types is to provide a carrier body protected by a sanitary surface material. Such surface material may extend itself to cover a shower cubicle, in particular with emphasis on the contour of the bottom. The said bottom contains a drain, and the surface may be that of tile or a like protective material. In any case, the surface possesses a waste water removal means and a desirable installation is to be quickly carried out with proper connection to the plumbing of an adjacent structure. Installation should include a simultaneous sealing off of the said adjacent structure, including flooring and/or walls. Besides the typical design disclosed in EP 1 388 317 A2, the document DE 20 2006 012 825 U1 presents for this service a hard curing, foamed carrier body upon which the bottom pan, i.e. carrier body shower bottom, can be placed. The carrier body consists, in this case, of a water-impervious material with, advantageously, a high degree of gross density, which density includes material and its porosity. Possible examples similar to this would be extruded foamed material such as a polyurethane substance requiring curing. Numerous foamed materials of varying properties are on the market are known to the state of the technology. Among these would be EPS (Expandable Polystyrene); XPS (Extruded Polystyrene); EPP (Expandable Polypropylene; and EPL (Extended Pot Life—a polyurea compound).

The upper bearing surface of the carrier body is preliminarily covered by an unbroken, sanitary coating, this being, for instance, an acrylic sealant. The upper bearing surface can also be laid with tile. Advantageously, this tiling can be done after the placement of the carrier body on the area intended to be occupied by the shower and its accessories. Additionally, in accord with certain surface treatment materials, these may be advantageously inclined in the direction of a drain opening, which opening must coincide with an existing flooring drain. In many instances of installation, the carrier body, combined with its protective coating is normally applied directly onto an existing underpinning, for example onto a flooring compound or a prepared substrate.

In accord with the localized conditions wherein the carrier body is to serve the intended shower, this body, with its sanitary surfacing, must be tightly sealed off from adjacent flooring. Using the sanitary top surfacing material for such sealing is a common practice. The points of sealing would include neighboring tile areas or walls, especially where said walls have been tile covered. The generic patent EP 1 388 317 A2 proposes that the outward rims of the carrier body are to be provided with sealing membranes placed between bearing surfaces and adjacent body edges adjoining existing surfaces. The sealing membrane is intended to overlap the periphery of the carrier body. In a case wherein a carrier body, finds itself adjacent to a previously installed flooring, then the described sealing membranes are to overlap the edges of the neighboring flooring compound. In this way, a moisture impervious bond is made between the shower base and the existing flooring.

DE 20 2006 012 825 U1 discloses a similar flooring connection. In this utility patent, an explanation is given in detail as to how the free edges of the carrier body can be affixed.

Carrier bodies complying with the previous state of the technology have been delivered to installation sites with custom made, predetermined dimensions. Insofar as the established dimensioning of the of the shower enclosure conforms to predetermined measurements, no problem exists in regard to sealing-off the carrier body in relation to its surroundings. In a case variant to this, if the predetermined dimensioning do not conform to the available space at the installation site, then, difficulties can arise in the application of sanitary topping surfacing during the mounting of the shower enclosure and its drain pan, in particular where tiles and limiting dimensions are concerned.

The purpose of the present patent is to obviate problems of this sort.

This purpose is achieved for a known carrier body by means of the features descibed below. Part of the sealing membrane is firmly affixed onto the bearing surface, the bottom pan area, and the exposed inner surface of the drain opening. Adhesion to flooring topping, or, to the edge surfaces of the carrier body is hereafter described. If necessity requires that the carrier body be manufactured to predetermined measurements of the shower space, then this dimensioning can be adjusted by vertical cutting. Since only a part of the sealing membrane is applied firmly onto an first (inner) part of the carrier body, then the remaining part of the sealing membrane, which overlaps the edges of the carrier body in a temporarily loose state can be folded back to clear the area. Thereafter, the carrier body can be correctly cut to a conforming size in the second (outer) partial area (FIG. 1) without sealing membrane being placed thereupon. Following the said cut-to-fit operation on the carrier body as required by dimensioning to meet the shower site, then the loose, outer area of the sealing membrane can be bound firmly to the residual section of the second (outer) partial area of the carrier body. This allows the so cut edges of the carrier body to be overlapped and establishes an advantage of creating a sealed binding about the periphery of the said carrier body. A method for the effective use of the carrier body is also described herein. Especially advantageously, it is possible that the invented carrier body can find productive application in the development of a bottom pan for a projected, sanitary enclosure, such as a shower cabinet.

Particular advantage is taken to assure that the area of sealing membrane is made larger than the surface of the carrier body to be overlaid. By this means, the carrier body can be installed even in such cases as occur in the described state of the present technology. In such cases it is not necessary that the carrier body be made to conform in its original factory-made dimensioning to the dimensions of the site of a shower enclosure. If such an event occurs, then those partial, outward areas of the sealing membrane, which first loosely overlap the carrier body, can be installed onto the corrected second (outer) surface of the carrier body in a simple manner at the construction site. The sealing membrane is so advantageously designed, that one side binds easily against the carrier body while the other, i.e., reverse side, is coated with adhesive. If necessary, the adhesive can be especially adapted for securing tiling.

It is also not necessary, that the sealing membrane be designed entirely as a flat surface. That is to say, the intention is to evenly overlap entirely the thereunder lying surface of the carrier body. Flatness is in order where the corresponding, edgewise partial area of the surface of the carrier body has been loosely overlapped. The purpose of this arrangement is that, in a case of specific conformity of the carrier body to the dimensioning of the shower enclosure, it then becomes possible that the custom-cut edges of the actual periphery are properly overlapped. At the same time, a continuous sealing between the carrier body and adjacent surfaces can be obtained.

In a particularly advantageous manner the sealing membrane is placed on the bearing surface of the carrier body. On the then remaining, freely accessible, upward extending surface of the sealing membrane, it is possible to lay tiles, flat stone sections and the like to bring about a finished placement about the shower enclosure. If a sanitary top surface material is to be placed over the carrier's bearing surface, then this can be a sanitary sealing membrane such as, for example, an acrylic layer to cover the underside of a shower enclosure bottom pan. In this way, the underside of carrier body can adapt itself to the existing dimensioning of the site of the shower installation and the sealing membrane can serve to protect adjacent, neighboring surfaces.

The drain opening in the carrier body must coincide with an existing drain in the flooring. Accordingly, the drain of the carrier body is to be sufficiently adjustable to exactly meet the centerline of draining connections. The invented sealing membrane is to cover the exposed, inner surface of the opening.

The carrier body, as aforesaid, can be brought into exact conformation with field dimensions during installation of the shower. Mounting and shower component alignments are aided if the drain pan bottom of the carrier body be provided with a field corrected rim periphery. To accomplish this correction, and thus ease the installation, the bearing surface of the carrier body has been provided with predetermined linear indentations. In this way, it is possible to make vertical cuts along the carrier body edge in the second (outer) area, guided by these indentations. By means of these guided cuttings, the premounting operation is considerably facilitated.

In the case of the advantageous method, in accord with the invention, it becomes important, that the sealing membrane be permanently bonded on first (inner) portion of the carrier body. In the remaining part of the carrier body surface, the sealing membrane loosely overlaps the carrier body surface on the second (outer) portion, which portion can now be custom cut to the dimensioning of the shower enclosure. A conforming fit can be made by means of cutting the carrier body vertically in the second (outer) portion, which, at this point of installation, is loosely overlapped by the said sealing membrane. Prior to the mentioned trimming by cutting, the loosely overlapping, sealing membrane is folded back to clear the second (outer) portion, which lies thereunder. Since the sealing membrane is now securely anchored adhesively against the first (inner) area, it becomes possible that the vertical cutting of the carrier body at the previously stated desired location can be carried out on the still remaining section of the second (outer) area portion. This need not disturb the loose sealing membrane, which is folded out of the way. In an especially advantageous manner, with a preliminary trimming, the sealing membrane can be so dimensioned, that it overlaps a rim-aligned area above the edges after the cutting is ended. In this way, trimming-to-fit time can be reduced. However, the trimming of the sealing membrane can also be carried out prior to, or after the involved edge surface has been firmly adhesively attached.

Examples of the invention are presented in the hereto attached drawings, which are explained in greater detail below:

FIG. 1: A perspective view of the invented carrier body, showing a sealing membrane covering its bearing surface.

Figure 2:
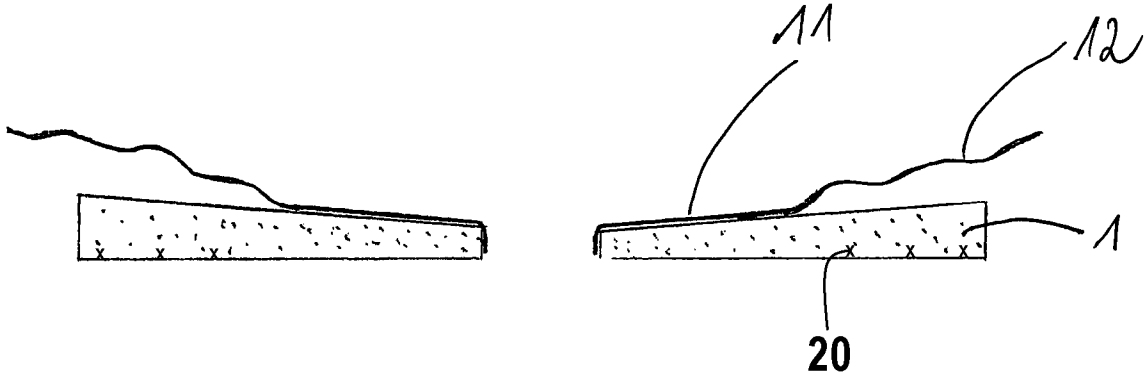

FIG. 2: A sectional view along Sec. I-I of FIG. 1, in an expanded scale.

Figure 3A:
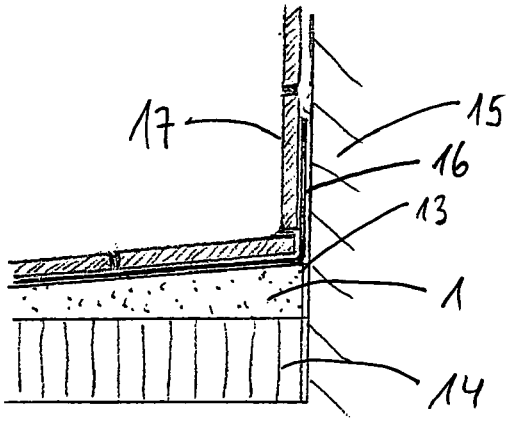
Figure 3B:
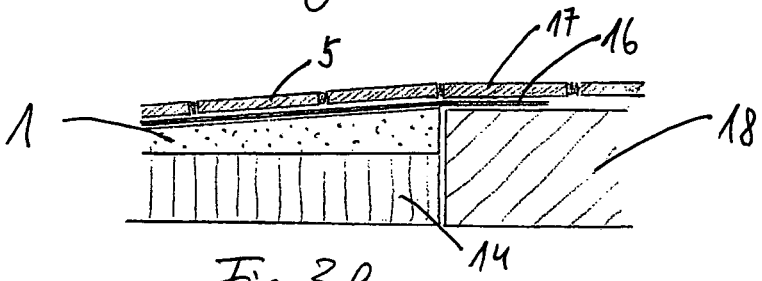
Figure 3C:
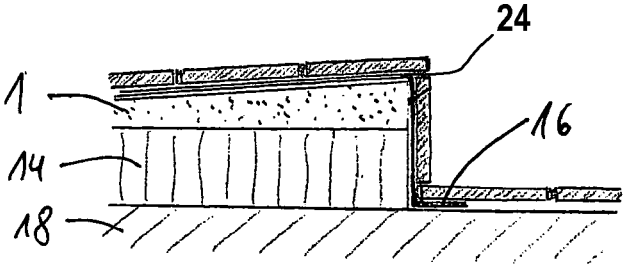

FIGS. 3*a* to 3*c*: The right side area of Sec. I-I of FIG. 2, which is cut through the carrier body and presents exemplary possibilities for mounting an invented carrier body adjacently to neighboring surfaces.

Figure 4:
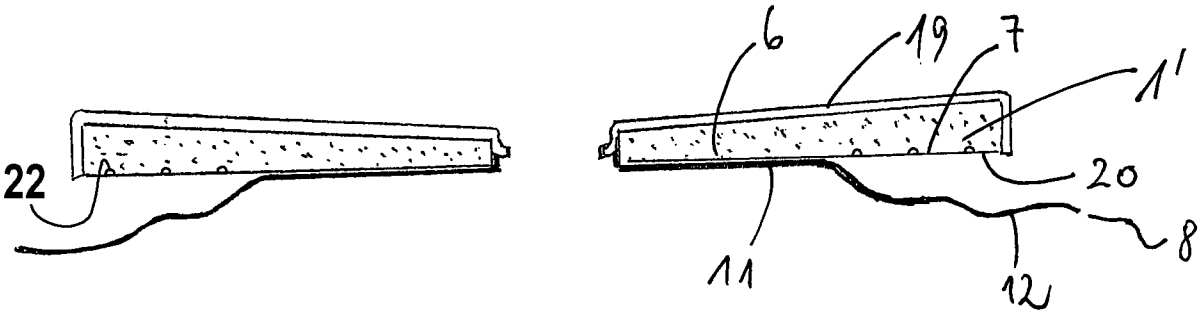

FIG. 4: A section through an invented carrier body, similar to that of FIG. 1 along the line I-I, drawn in a greater scale, wherein the sealing membrane has been affixed to the inner bottom side of the carrier body.

FIGS. 5*a* to 5*g*: The right side area of the section shown in FIG. 4, presenting exemplary possibilities for the mounting of the invented carrier body onto neighboring surfaces. In the following is to be found an explanation and a more detailed description of the invention, with the aid of the above Figures, in accord with surrounding construction and, where necessary, also providing the method of operation of the said invention.

FIG. 1

In the perspective presentation of FIG. 1, the invented carrier body 1 is depicted from an inclined view from above. In this view, the carrier body 1 possesses an upward exposed bearing surface 2, which is to be provided with a sanitary surfacing material 3. This surfacing material may be an acrylic coating or a tile covering or the like. In the perspective view of FIG. 1 the basic bearing surface 2 is designated as having within its borders an inner, centrally located "first" partial area 6. Correspondingly, the surface 2 also possesses a peripherally surrounding outer "second" partial area 7. The said first (inner) partial area 6 of the bearing surface 2 is that portion of the said bearing surface 2 of the carrier body 1 upon which a sealing membrane 8 is adhesively affixed. This sealing membrane 8 is represented in FIG. 1 by dashed lines and extends outward away from the first (inner) partial area 6. The same sealing membrane 8, however, covers the second (outer) second partial area 7 of the bearing surface 2 in a temporarily loose, non-affixed manner. As the perspective presentation of FIG. 1 indicates, that the sealing membrane 8 thus overlaps the edges 9 at the periphery of the carrier body 1.

In this perspective presentation of FIG. 1, the bearing surface 2 is shown inclining itself downward from all directions toward a center point. At this center point of the carrier body 1 is provided an opening 10, which serves for connection to existing draining facilities in, presumably, a substrate and/or a supporting flooring.

In accord with the invention, it remains possible for the carrier body 1, as may be seen in the section of the second (outer) partial area 7, to be adjusted into alignment with the field dimensioning of the shower location. This adjustment could be carried out in some instances by means of a cut-to-fit operation. This advantageous adaption of size can be carried out on site by workmen with tools readily at hand, including, for example, a saw. Thus, in accord with this operation, a rapid and simple fitting of the outside dimensions of the carrier body 1 to the space requirements of the shower site is made possible at any time.

FIG. 2

In FIG. 2, the FIG. 1 section along the line I-I of the carrier body 1 is shown in an enlarged scale. In FIG. 2, the first partial (inner) area 6 is made evident with a firmly attached part 11 of the sealing membrane 8. Likewise is exhibited the second partial (outer) area 7 with an overhanging, loose part 12 of the sealing membrane 8. As has already been mentioned, in the case of the through-cutting of the carrier body 1, first, the mentioned loose part 12 of the sealing membrane is folded back out of the way. Thereafter, the carrier body 1 is separated, i.e. cut, through the second (outer) area 7. When the cutting is finished, then the loose part 12 of the sealing membrane is again brought down onto the now trimmed section of the second (outer) partial area 7 and firmly attached thereto by adhesive means. When this is done, either before or after the cutting and adherent affixing, the loose part 12 of the sealing membrane 8 can be evenly trimmed. The result of this trimming allows the now cut-to-fit edge 13 (see FIG. 3*a*) of the second (outer) part of the carrier body 1 to be evenly overlapped by the sealing membrane 8.

FIG. 3*a*

As the next step, the mounting of the carrier body 1 can now be executed and the said body fitted in alignment with the neighboring surfaces. In methods of operational possibilities, as set forth in FIGS. 3*a* to 3*c*, the carrier body 1 is shown as resting on a substrate 14 and its newly cut edge 13 abuts a wall 15. The sealing membrane residual portion 16, which remains after the cutting of the carrier body 1, is shown in FIG. 3*a* drawn upward (relative to this drawing) along the wall 15. This provides a seal between the wall 15 and the carrier body 1. Tiles 17 may now be laid against the wall 15 and the sealing membrane 16.

FIG. 3*b*

In the case of the example shown in FIG. 3*b*, the carrier body 1 is laid over a substrate 14 with a neighboring flooring 18 situated thereunder. In this case, the sealing membrane extension 16 is brought over the joint between the carrier body 1 and the flooring 18. Further, on the upper side of the flooring 18, an adhesive has been applied to unite the two. Likewise tiles 17 are laid against the flooring 18 with the sealing membrane edge 16 protruding from under the tile 5 of the carrier body 1 and intervening therebetween, thus overlapping the joint.

FIG. 3*c*

As a final possibility in this installation example, it remains to be shown in FIG. 3*c*, the manner in which the structure of the substrate 14, the carrier body 1, the thereon applied sealing membrane 8 and the tiles 5 are laid upon the said flooring 18. The continuing extension of the tiling 5 proceeds over the end surface of the carrier body 1, follows along the end edge of the substrate 14 and continues over the flooring 18. From this FIG. 3*c* can be inferred, that the sealing membrane section 16 is allowed to extend itself beyond the corner between the substrate 14 and the flooring 18. This extension of the sealing membrane section 16 provides an assuredly sufficient sealing.

FIG. 4

The arrangement of an alternate example of the carrier body 1' is presented in the section shown in FIG. 4. This invented version of the carrier body 1' represents principally the same construction as that of carrier body 1 of FIG. 1. Accordingly, FIG. 4 displays a similar cross section through the carrier body 1' as has been done in FIG. 2. However, in this case, the carrier body 1' of the FIG. 4 differentiates itself from the previous version, in that on its top exposed bearing side 2, it has been protected with a preinstalled acrylic covering material 19. This acrylic covering 19 extends itself, in the FIG. 4, along the carrier body 1' at least to partially over the peripheral edge thereof. It may be inferred from FIG. 4, that the sealing membrane 8, in this case, has been applied against the undermost, i.e. the bottom, surface 20 of the carrier body 1'. In correspondence to the invented constructive example shown in the FIGS. 1 and 2, this said bottom surface is likewise in a first (inner) partial area 6, where the sealing element 8 has been adhesively firmly affixed. Likewise, a second and loose segment of the sealing element 8 extends itself freely in proximity to the second (outer) partial area 7 of the carrier body 11.

The cutting to desired dimensioning of the carrier body 1', where FIG. 4 is concerned, is done in the same manner as described previously in regard to FIG. 2. Again in this case, it is of the essence, that upon the cutting through of the carrier body 1 in the second (outer) partial area 7, the loose part 7 of the sealing membrane 8 remain in an uncut state. By means of the inventive carrier body 1', it becomes possible, that the shower location can be specifically defined, with consideration being given to specific dimensioning and that the erection and sealing of the same can be carried out without difficulty.

FIGS. 5*a* TO 5*g*

In the FIGS. 5*a* to 5*g* are to be found, once again, clearly exemplary possibilities for the placement of the carrier body 1' against the neighboring and adjacent objects and surfaces, such as walls 15, flooring 18 and the like. Principally in 5*b*, the determination has been made, that a cut-to-fit carrier body 1' is involved, which is supported on a substrate 14 and is then sealed off against a wall 15 with the aid of the sealing membrane extension 16. Even in this case, corresponding to the construction example of FIG. 3*a*, the contact area between the sealing membrane residual part 16 and the wall 15 is provided with a tile 17 installation.

The arrangements shown in FIG. 5*a*, as well as in FIGS. 5*c* to 5*g*, demonstrate, for instance, a carrier body 1', which is not cut, so that the acryl covering 19 thereof, remains untouched. In FIG. 5*a* is shown an arrangement of the carrier body 1', wherein, in accord with the cut carrier body 1' described in FIG. 5*b*. In this FIG. 5*b* is shown the carrier body 1' supported on its substrate 14 and this arrangement is then supported on a flooring 18. Such an arrangement is also shown in FIG. 3*c*. In FIG. 5*d* the carrier body 1' is found, for example, with the sealing membrane 8 extended thereunder and accordingly lying between the carrier body 1' and the flooring 18. Also in FIG. 5*d* is to be seen, how the said sealing membrane extension 16 is brought further over the flooring 18, away from the shower site. Made evident also, is that the flooring 18 is sealed off against the carrier body 1', so that the tiling 17 can be laid in an orderly manner onto the sealing membrane section 16 and the flooring 18. In the example depicted in FIG. 5*e*, the substrate 14 with the thereupon laid carrier body 1' is provided to be somewhat higher in elevation than the adjacent flooring 18. Consequently the tiling 17 can be slipped in therebelow. Again in this case, a sealing is effected at the given points of impact by means of the sealing membrane section 16. Counter to this, in FIG. 5*f*, a situation is demonstrated, wherein the substrate 14 is lower than the level of the flooring 18.

In the case of FIG. 5*f*, upon the laying of the tile on the flooring 18, a small difference in elevation marks the joint between the acrylic covering of the carrier body 1' and the subsequent area of tile 17. FIG. 5*g* makes further adjustment, wherein the combination of the carrier body 1' and the substrate 14 is so aligned with the flooring 18 and its tile 17 covering, that a smooth extension to the bottom is achieved. In both FIGS. 5*f* and 5*g*, as can be seen, in actual installation, the sealing membrane extension 16 is folded away, thus projecting over the flooring 18.

The bearing surface 2 and/or the under surface 20 may possess predetermined linear indentations in order that a penetrative, vertical cutting can be carried out along the said indentations. FIG. 2 illustrates such indentations 22 formed on the under surface 20 (each indention being shown representationally as an "x" in the drawing).

The invention claimed is:

1. A method for installing the floor of a shower installation or the like comprising the steps of:

(a) providing a carrier body assembly comprising a carrier body and a sealing membrane, the carrier body being a rigid body and comprising an upper surface, a lower surface, an outer periphery extending around the body, and a drain opening extending through the carrier body from the upper surface to the lower surface, the upper surface sloping towards the drain opening for flowing shower water falling on the upper surface to the drain opening, the sealing membrane comprising an inner portion and a flexible, pliant outer portion surrounding the inner portion, the inner portion permanently affixed to and covering one of the said inner and outer surfaces of the carrier body, the outer portion of the sealing membrane at least partially not permanently affixed to the carrier body and foldable away from the carrier body, the outer portion being foldable along a non-predetermined fold line, portions of the outer portion of the sealing membrane disposed on opposite sides of the fold line and immediately adjacent the fold line being foldable along the fold line 90 degrees or more while maintaining the integrity of the sealing membrane, the outer portion of the sealing membrane extendable beyond the entire outer periphery of the carrier body;

(b) placing the carrier body on a substrate to support the carrier body and in close alignment with a neighboring surface to define the location of the floor of the shower installation, the upper surface of the carrier body facing away from the substrate;

(c) placing the outer portion of the sealing membrane over the outer portion of the said one of the upper and lower surfaces of the carrier body and adhering the sealing membrane to the outer portion whereby the sealing membrane covers and adheres to the entire said one of the upper and lower surfaces of the carrier body; and (d) extending the sealing membrane away from the carrier body and against the neighboring surface whereby the sealing membrane defines a continuous surface extending from the carrier body to the neighboring surface that forms a seal between the carrier body and the neighboring surface.

2. The method of claim 1 comprising the steps of:

(e) folding the outer portion of the sealing membrane away from the carrier body to expose a portion of the carrier body, and (f) trimming the exposed portion of the carrier body so that the carrier body can be placed in close alignment with the neighboring surface.

3. The method of claim 2 wherein step (f) comprises the step of vertically cutting along an edge of the carrier body, the cutting being guided by one or more predefined indentations provided on at least one of the upper surface and the lower surface of the carrier body.

4. The method of claim 1 wherein the neighboring surface extends upwardly away from the carrier body when the carrier body is placed on the substrate, and step (d) comprises the step of:

(e) folding the sealing membrane upwardly away from the carrier body to place the sealing membrane against the neighboring surface.

5. The method of claim 4 wherein the sealing membrane is attached to the lower surface of the carrier body and step (e) comprises the step of:

(f) folding the sealing membrane upwardly beyond the upper surface of the carrier body to place the sealing membrane against the neighboring surface whereby the sealing membrane is disposed between the carrier body and the neighboring surface.

6. The method of claim 1 wherein the neighboring surface is located at an elevation below the membrane when the carrier body is placed on the substrate, and step (d) comprises the step of:

(e) folding the sealing membrane downwardly away from the carrier body to place the sealing membrane against the neighboring surface.

7. The method of claim 6 wherein the sealing membrane is attached to the upper surface of the carrier body and step (e) comprises the step of:

(f) folding the sealing membrane downwardly beyond the lower surface of the carrier body to place the sealing membrane against the neighboring surface whereby the sealing membrane completely surrounds the carrier body.

8. The method of claim 1 further comprising the step of:

(f) placing a covering material on the sealing membrane after the sealing membrane is placed against the neighboring surface, the covering material hiding the sealing membrane from view.

9. The method of claim 8 further comprising the step of:

(g) trimming the outer portion of the sealing membrane prior to conform the sealing membrane with the neighboring surface.

* * * * *